US005738799A

United States Patent [19]

Hawkins et al.

[11] Patent Number: 5,738,799

[45] Date of Patent: Apr. 14, 1998

[54] METHOD AND MATERIALS FOR FABRICATING AN INK-JET PRINTHEAD

[75] Inventors: William G. Hawkins, Webster; Cathie J. Burke, Rochester; Mildred Calistri-Yeh, Geneva; Diane Atkinson, Webster, all of N.Y.

[73] Assignee: Xerox Corporation, Stamford, Conn.

[21] Appl. No.: 712,761

[22] Filed: Sep. 12, 1996

[51] Int. Cl.[6] ..... B41J 2/04; B41J 2/01; B41J 2/21

[52] U.S. Cl. ..... 216/27; 216/2; 216/33; 347/44; 347/45

[58] Field of Search ..... 216/27, 2, 33; 347/44, 45

[56] References Cited

U.S. PATENT DOCUMENTS

| | | | |
|---|---|---|---|
| 4,497,684 | 2/1985 | Sebesta | 156/643 |
| 4,650,545 | 3/1987 | Laakso et al. | 156/655 |
| 5,236,572 | 8/1993 | Lam et al. | 205/75 |
| 5,296,092 | 3/1994 | Kim | 156/643 |
| 5,322,594 | 6/1994 | Bol | 156/634 |
| 5,378,583 | 1/1995 | Guckel et al. | 430/325 |
| 5,401,983 | 3/1995 | Jokerst et al. | 257/82 |
| 5,454,904 | 10/1995 | Ghezzo et al. | 216/13 |
| 5,465,009 | 11/1995 | Drabik et al. | 257/723 |

*Primary Examiner*—Susan A. Loring
*Attorney, Agent, or Firm*—R. Hutter

[57] ABSTRACT

An ink-jet printhead fabrication technique enables capillary channels for liquid ink to be formed with square or rectangular cross-sections. A sacrificial layer is placed over the main surface of a silicon chip, the sacrificial layer being patterned in the form of the void formed by the desired ink channels. A permanent layer, comprising permanent material, is applied over the sacrificial layer, and, after polishing the two layers to form a uniform surface, the sacrificial layer is removed. Preferred materials for the sacrificial layer include polyimide while preferred materials for the permanent layer include polyarylene ether, although a variety of material combinations are possible.

51 Claims, 4 Drawing Sheets

| SACRIFICIAL LAYER (SL) | SL PATTERNING METHOD | PERMANENT LAYER | DISSOLVING CHEMICAL |
|---|---|---|---|
| PMDA-ODA POLYIMIDE | PHOTOPATTERN | POLYIMIDE | KOH, BASES, OR NUCLEOPHILIC AGENTS |
| RISTON®, VACREL® | PHOTOPATTERN | POLYIMIDE | METHYLENE CHLORIDE |
| PLASMA NITRIDE OR OXIDE, SPIN ON GLASS | WET OR PLASMA ETCH | POLYIMIDE | HF, $H_3PO_4$ |
| RISTON®, VACREL®, POLYIMIDE | PHOTOPATTERN | POLYPHENYLENES, PHENOLPHTHALEIN-CONTAINING ARYLENE ETHERS, PROBIMER, BENZOCYCLOBUTENES | METHYLENE CHLORIDE, KOH, NMP |
| PHOTORESIST | PLASMA ETCH OR PHOTOPATTERN | ABOVE MATERIALS | RESIST STRIPPER, BASES |
| PHOTORESIST OR POLYIMIDE | PHOTOPATTERN | $SiO_2$, $Si_3N_4$ | PLASMA ASH, STRIPPER |
| POLYIMIDE OR ANY OF THE ABOVE | AS NEEDED FOR SL | POLYARYLENE ETHER | AS NEEDED FOR SL |
| PSG | PHOTORESIST WITH WET OR DRY ETCH | POLYIMIDE | HF |

FIG. 9

METHOD AND MATERIALS FOR FABRICATING AN INK-JET PRINTHEAD

The present invention relates to techniques and special materials for fabricating micromechanical devices, particularly ink-jet printheads, and to an ink-jet printhead made according to this technique.

In thermal ink-jet printing, droplets of ink are selectably ejected from a plurality of drop ejectors in a printhead. The ejectors are operated in accordance with digital instructions to create a desired image on a print sheet moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated and vaporized by a heating element (essentially a resistor) disposed on a surface within the channel. This rapid vaporization of the ink adjacent the channel creates a bubble which causes a quantity of ink to be ejected through an opening associated with the channel to the print sheet. One patent showing the general configuration of a typical ink-jet printhead is U.S. Pat. No. 4,774,530, assigned to the assignee in the present application.

In overview, a thermal ink-jet printhead such as of typical designs known in the art is a hybrid of a semiconductor and a micromechanical device. The heating elements are typically polysilicon regions doped to a particular resistivity, and of course the associated digital circuits for activating individual heating elements at various times are all well within the realm of semiconductor technology. Simultaneously, structures such as the capillary channels for retaining liquid ink and ejecting the ink from the printhead are mechanical structures which directly physically interface with the semiconductors such as the heating element or heater chip. For various reasons it is desirable to make mechanical structures such as the channel plate out of chemically etched silicon which is congruous with the semiconductor structure of the heater plate.

Using standard silicon-etching technology to create micromechanical structures, however, presents significant design constraints. Typically grooves in the channel plate, which are used to form capillary channels for the passage of ink therethrough, are typically most easily constructed with V-groove etching such as by applying a chemical etchant such as KOH to silicon. Because of the relative etching rates along different directions of a silicon crystal (the "aspect ratio"), etched cavities defining specific surface angles will result, forming the distinct V-grooves. When a channel plate defining etched V-grooves is abutted against a semiconductor heater chip, capillary channels which are triangular in cross-section are created. Such triangular cross-sections provide certain advantages, but are known to exhibit problems in directionality of ink droplets emitted therefrom; i.e., ink droplets are not always emitted straight out of the channel, but rather may be emitted at an unpredictable angle. It is likely that the performance of the chip could otherwise be improved if, for example, a cross-section which is closer to a square could be provided. However, the aspect ratio for the etching of silicon in typical etching processes would preclude creation of square-shaped grooves in a channel plate.

Another disadvantage of using V-grooves to form capillary channels is that it would be difficult to create, using V-groove etching, a channel which would vary in cross-section along the length of the channel. It would be difficult, for example, to create through V-groove etching a channel which increased or decreased in size along its length. In summary, while the V-groove etching technique has key practical advantages, there are also important design constraints associated with it.

The present invention describes a method, along with associated sets of material with which the method is preferably practiced, by which structures such as are useful in an ink-jet printhead can be created with more flexibility than with traditional V-groove etching techniques.

In the prior art, U.S. Pat. No. 4,497,684 discloses a technique, using sacrificial layers, to deposit metal layers in a pattern on a substrate.

U.S. Pat. No. 4,650,545 discloses a technique for making metal conductors which adhere to polyimide layers. The metal conductors are laid on a sacrificial substrate, and then the polyimide layer is laid over the conductor and substrate. The substrate is then etched away to expose the conductor.

U.S. Pat. No. 5,236,572 discloses a method for continuously manufacturing parts requiring precision microfabrication, such as ink-jet printheads. The pattern-bearing surface of a mandrel is moved through an electroforming bath. While the mandrel moves through the bath, a metal layer is deposited on the mandrel surface.

U.S. Pat. No. 5,296,092 discloses a planarization method for use with a semiconductor substrate. An insulating layer is coated on the semiconductor substrate having a metal wiring layer thereon, and then a resist layer serving as a sacrificial layer is formed on the insulating layer.

U.S. Pat. No. 5,322,594 discloses a method of manufacturing a one piece full-width ink-jet printing bar on a glass or ceramic plate. A sacrificial material is used to form the voids which are necessary as jet chambers.

U.S. Pat. No. 5,378,583 discloses a technique for forming microstructures using a preformed sheet of photoresist. Micrometal structures are formed by electroplating metal into areas from which the photoresist has been removed.

U.S. Pat. No. 5,401,983 discloses various techniques for monolithically integrating any thin film material or any device, including semiconductors. The technique involves separation of the thin film material from a growth substrate.

U.S. Pat. No. 5,454,904 discloses a micromachining method wherein a polyimide is utilized as a micromachinable material.

U.S. Pat. No. 5,465,009 discloses techniques to permit lift-off, alignment and bonding of materials and devices. A device layer is deposited on a sacrificial layer situation on a growth substrate. The device layer is coated with a carrier layer. The sacrificial layer and/or the growth substrate are then etched away to release the combination of the device layer and carrier layer from the growth substrate.

According to the present invention, there is provided a method of fabricating a micromechanical device defining channels therein, such as an ink-jet printhead. A substrate defining a main surface is provided. A sacrificial layer of removable material, configured as a negative mold of the desired channels, is deposited on the main surface. A permanent layer of permanent material is deposited over the main surface and the sacrificial layer. The permanent layer is polished to expose the sacrificial layer, and then the sacrificial layer is removed.

IN THE DRAWINGS

FIG. 9 is a table showing known sets of materials which can be used to carryout the technique of the present invention in creating a thermal ink-jet printhead.

Figure 1:
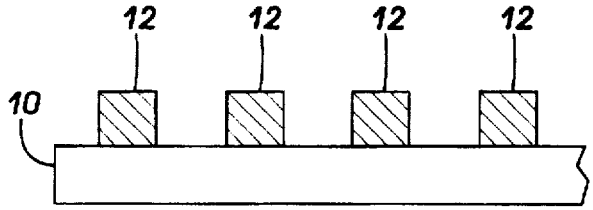
FIGS. 1–5 are a sequence of elevational views of capillary channels for an ink-jet printhead being formed on a silicon substrate.

FIGS. 1–5 show a plan view of a portion of a semiconductor substrate having structures thereon, as would be used, for example, in creating a portion of a thermal ink-jet printhead. The successive Figures show the different steps in the method according to the present invention. In the Figures, like reference numerals indicate the same element at different stages in the process.

FIG. 1 shows a semiconductor substrate 10 having disposed, on a main surface thereof, a series of sacrificial portions 12, which together can be construed as a single sacrificial layer. As shown in FIG. 1, the individual sacrificial portions 12 are intended to represent a set of capillary channels for the passage of liquid ink therethrough in, for example, a thermal ink-jet printhead. As will be described below, the sacrificial portions 12 represent the configuration of voids (such as for capillary channels) in the finished printhead; the portions 12 can be construed as forming a negative of a mold. In the finished printhead, these capillary channels are intended to be disposed on the main surface of chip 10, in such a manner that the main surface of chip 10 serves as one wall of each capillary channel. In FIG. 1, four separate and parallel channels are shown "end-on."

Different materials which can be used to create sacrificial layer 12 will be discussed in detail below, but, depending on the particular material selected, the sacrificial layer 12 can be deposited in a desired pattern on the main surface of chip 10 using any number of a familiar techniques, such as laser etching, chemical etching, or photoresist etching.

Figure 2:
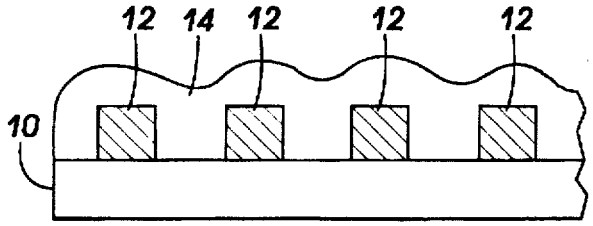

In FIG. 2 is shown the placement of a permanent layer 14 over the portions 12 of the sacrificial layer. Permanent layer 14 will ultimately be used to define the voids which, in FIG. 2, are occupied by sacrificial layers 12. It will be noted that, in the illustrated embodiment, the parallel-channel pattern of sacrificial layer 12 causes an undulating surface to be created by permanent layer 14. The permanent layer 14 can be deposited by any number of available techniques, such as spin casting, spray coating, screen printing, CVD or plasma deposition. A detailed discussion of what materials are most suited for permanent layer 14 will be given below.

Figure 3:
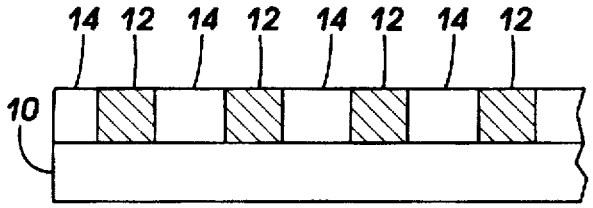

In FIG. 3 the permanent layer 14, which has been hardened to a solid, has been mechanically polished in such a manner that a single flat surface is obtained, with different areas thereof being formed by portions of permanent layer 14 or exposed portions of sacrificial layer 12. Depending on the particular materials selected for layers 12 and 14, this polishing step can be carried out by any of a variety of known techniques, such as mechanical polishing or laser ablation.

Figure 4:
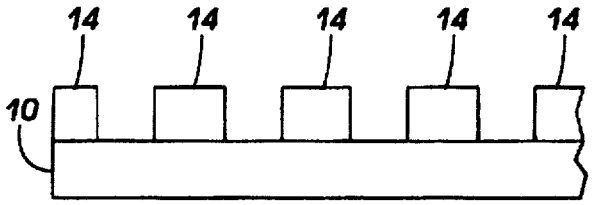

In FIG. 4 the sacrificial layer, represented in previous Figures by portions 12, has been removed. According to a preferred embodiment of the present invention, this removal of sacrificial layer 12 is carried out by chemical etching, although other techniques may be possible. It can be seen that there are now precisely-shaped channels where the sacrificial layers 12 used to be. These channels can in turn be used for passage and retention of liquid ink, such as a thermal ink-jet printhead. It will further be noted that substantially right angles can be provided between the walls of permanent layer 14 and the "floor" formed by the main surface of chip 10 within each channel. This is shown in contrast to previous typical designs of ink-jet printheads, using V-groove etching, wherein only triangular-cross-section channels are practical.

Figure 5:
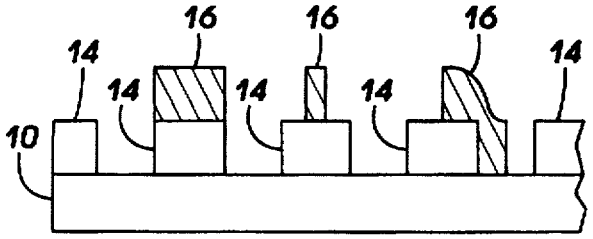

FIG. 5 shows a possible subsequent step in the process of the present invention, wherein further structures can be provided on the remaining portions of the permanent layer 14. As shown, a second sacrificial layer 16 can be placed in various ways over the permanent layer 14, such as by placing the sacrificial layer 16 entirely over a portion of permanent layer 14, or else, as shown toward the right of FIG. 5, placing a portion of the sacrificial layer 16 over permanent layer 14 or over the remaining exposed main surface of chip 10. The steps shown in FIG. 1–4 can thus be repeated over the existing permanent layers 14 in order to create fairly sophisticated three-dimensional structures. Alternately, multiple permanent layers of the same general plan design can be "stacked" on top of each other, thereby creating "trenches" having a high aspect ratio of height to width. The only significant constraint on creation of structures in higher layers is that there should be access for "buried" sacrificial layers, whereby removal chemicals can be applied to lower sacrificial layers, or the dissolved substance of sacrificial layers may be drained out.

Figure 6:
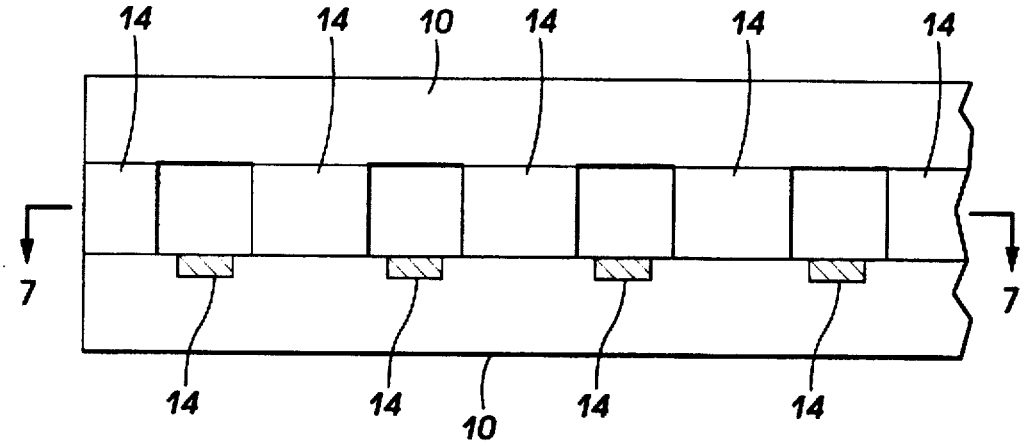
FIG. 6 is an elevational view of a more completed thermal ink-jet printhead made according to the technique of the present invention.

FIG. 6 is an elevational view of a substantially finished ink-jet printhead exploiting, for example, the structure shown in FIG. 4. It will be noted that the semiconductor substrate 10 has defined therein (such as through semiconductor fabrication means known in the art) a series of heating elements 24 on which the channels formed by permanent layer 14 are aligned. As is known in the art of thermal ink-jet printing, application of a voltage to a heating element such as 24 will cause nucleation of the liquid ink being retained in the channel, which in turn causes the liquid ink to be ejected from the channel and onto a print sheet. (More broadly, the heating element 24 could be replaced with another kind of structure to energize the liquid ink and cause ejection of ink from the channel, such as a piezoelectric structure; in the claims hereinbelow, a heating or other structure is generalized as an "energizing surface.") Disposed over the "top" surface provided by permanent layer 14 is a simple plane layer 20, which in effect completes the channels formed by semiconductor substrate 10 and the walls of permanent layer 14 so that enclosed (but open-ended) capillary channels are created. Typically, plane layer 20 need not have any particular sophisticated structure associated therewith, and can be made of an inexpensive ceramic, resin, or metal.

Figure 7:
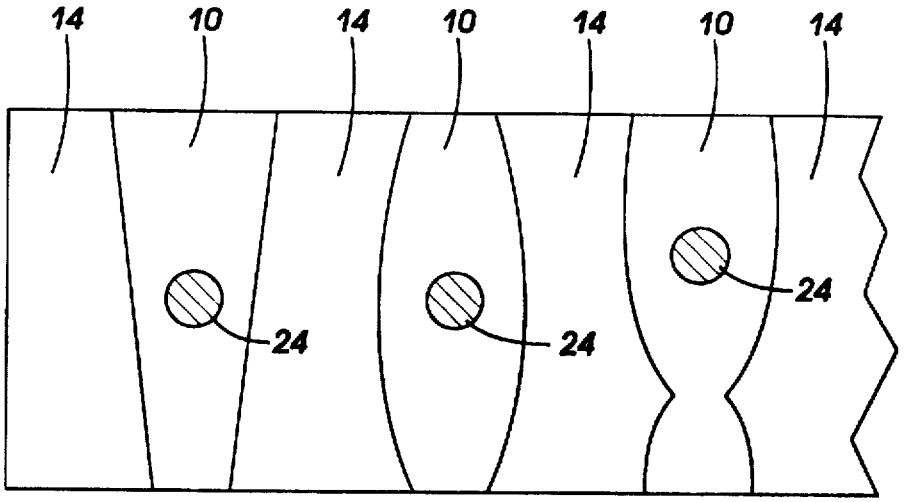
FIG. 7 is a sectional plan view through line 7—7 in FIG. 6, illustrating different channel shapes which may be formed with the technique of the present invention.

FIG. 7 is a plan view showing how the technique of the present invention can, by virtue of using permanent layer 14 to facilitate channel shapes which vary in cross-section along the length thereof, to an extent that is impossible with channels which are created in directly etched grooves. The channels are created by placing on the substrate sacrificial layers 12 which are shaped like the desired channels in the finished printhead. FIG. 7 merely shows three possible examples of such odd-shaped channels: of course, all of the channels would be of the same general design in a practical printhead. However, as shown, the various possible shapes of the channels created by permanent layer 14 facilitate shapes which can be optimized relative to, for example, the position of the heating element 24 in semiconductor chip 10.

Figure 8:
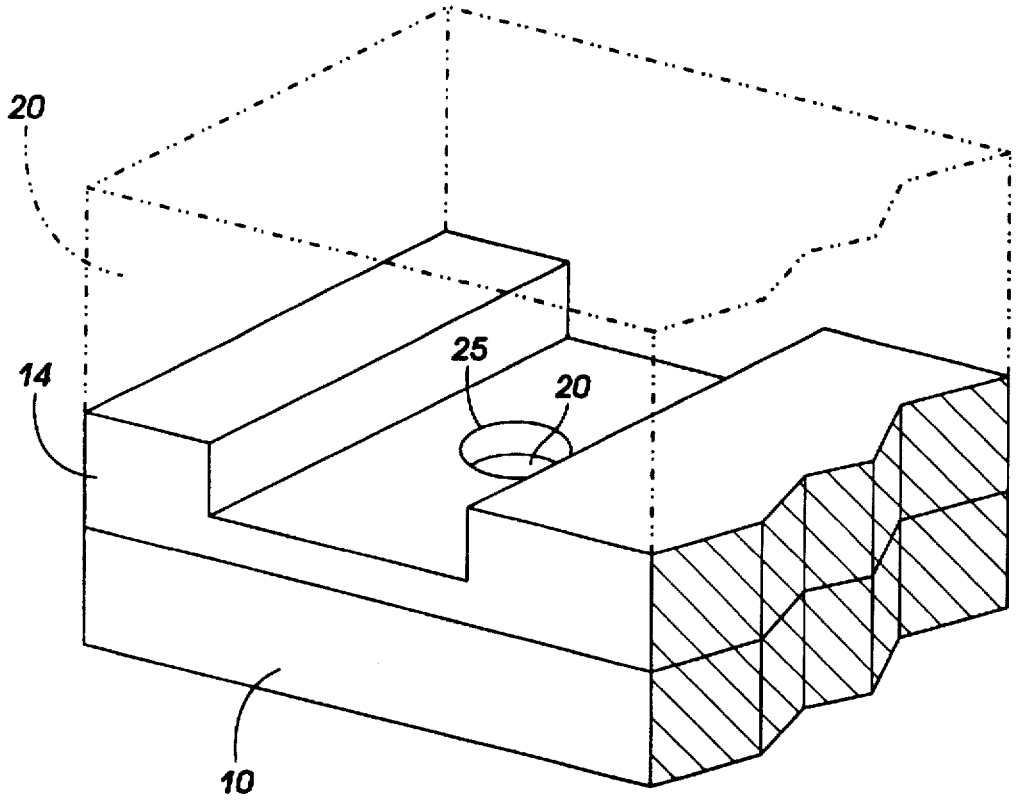
FIG. 8 is a perspective view showing how the technique of the present invention can be used to form pits around heating elements in an ejector in a thermal ink-jet printhead.

FIG. 8 is a perspective view of an ejector made according to the technique of the present invention, showing an important printhead design which can be readily enabled with the technique of the present invention. In a printhead in which a heating element 24, such as shown in FIG. 7, is defined within a heater chip 10, permanent layer 14 can be used not only to define an ejector channel, but also to form a pit, indicated as 25, which is spaced around, or closely to, the perimeter of the surface of heating element 24. This pit 25 is known in the art as a structure which can improve the performance of a thermal ink-jet ejector by providing a specific zone for ink nucleation. In prior art printheads, such pits such as 25 are formed in their own separate layers, such as a polyimide, which must be provided to the printhead chip in a separate manufacturing step. With the technique of the present invention, however, a structure defining a pit 25 around every heating element 24 can be formed in a single piece with the rest of the sides of the ejector, by permanent layer 14. That is, the present invention enables structure defining pit 25 to be formed out of essentially the same layer of material that defines the walls of the ejector itself. Formation of this pit 25 in permanent layer 14 can be performed by multiple iterations of the sacrificial layer technique as shown in FIG. 5.

Although, in the illustrated embodiment, the negative-mold technique is used for the creation of capillary channels in a thermal ink-jet printhead, the technique can be used to form other types of cavities in a printhead, such as to make the ink-supply manifolds through which ink is supplied to the channels in the printhead. Broadly, the technique of the present invention can be applied to making any specially-shaped void in a micromechanical apparatus, and can readily be applied to the creation of voids having a critical dimension (i.e. along a dimension parallel to the main surface of the substrate) from about 3 micrometers to about one centimeter.

Having demonstrated the basic steps of the technique of the present invention, attention is now directed to specific combinations of materials which can be used for sacrificial layer 12 and permanent layer 14. The specific selection of a combination of such material will depend not only on cost and ease of use for obtaining a particular shape of permanent layer 14, but must be inevitably take into account the specific requirement for an entire printhead, namely the composition of liquid inks which are likely to be used with the printhead. Because of various competing concerns such as ink drying and clogging, etc., it is fairly common that liquid inks used in ink-jet printing have characteristics such as acidity or baseness; these qualities have been known to cause degradation of common materials used in printheads. Also, other inks are nucleophilic, which further limits the choice of materials for a printhead.

FIG. 9 is a table giving, in general terms, various preferred combinations of sacrificial layer material, permanent layer material, sacrificial layer patterning methods, and dissolving chemicals, representing various practices of the invention known to the inventors as of the time of filing. In brief, the necessary attributes of a sacrificial material is that it be patternable (either by being photosensitive itself, or being patternable by the application of a photoresist), and removable (such as by wet or plasma chemical etching, ion bombardment, or ablation). Necessary attributes of the permanent material, in the ink-jet printing context, are that the material be resistant to the common corrosive properties of ink, (such as acid/base, nucleophilic, or otherwise reactive), should exhibit temperature stability, and be relatively rigid so that, if necessary in certain manufacturing processes, the created structures are diceable (that is, if a large number of printhead chips are made in a single wafer, the wafer must be able to be cut into individual chips). While various combinations of various materials and methods have been shown to be practical, the choice of which particular combination is a "best mode" will depend on external factors, such as the choice of ink used in the printhead, as well as cost. On the whole, the most versatile materials for permanent layers in the ink-jet printing context are polyarylene ether or polyimide.

In one embodiment of the claimed invention, different types of polyimide can be used respectively for the sacrificial and permanent layers. If two types of polyimide are used, the polyimide used for the sacrificial layer should be a partially-cured polyimide, while the polyimide for the permanent layer should be a fully-cured polyimide. Alternately, the polyimide used for sacrificial layer should be a base-sensitive polyimide, while the polyimide for the permanent layer should be a less base-sensitive polyimide.

The table of FIG. 9 lists certain proprietary substances such as those known under the trademarks of RISTON® and VACREL®, both available from E.I. du Pont De Nemours & Company. In the claims hereinbelow, these proprietary materials are referred to as "dry-film solder masks."

In the context of manufacturing ink-jet printheads, a single layer of permanent material 14 can be readily created up to a thickness of 60 micrometers. Such a layer will still exhibit the desirable right-angle relationship between the walls of the permanent layer such as 14 and the surface of the silicon substrate 10. However, by using multiple iterations of the present method, such as shown in FIG. 5, the thickness of such a permanent layer 14 comprising several such layers could easily reach into the tens of millimeters. The thickness of structures created by one or more permanent layers 14 is fundamentally constrained only by the mechanical stability of such walls, i.e., a wall created by permanent layer 14 need only be thick enough to support itself in a particular situation.

Further information regarding the preparation of polyarylene ethers and the like is disclosed in, for example, P. M. Hergenrother, *J. Macromol. Sci. Rev. Macromol Chem.*, C19 (1), 1–34 (1980); P. M. Hergenrother, B. J. Jensen, and S. J. Havens, *Polymer*, 29, 358 (1988); B. J. Jensen and P. M. Hergenrother, "High Performance Polymers," Vol. 1, No. 1 ) page 31 (1989), "Effect of Molecular Weight on Poly (arylene ether ketone) Properties"; V. Percec arid B. C. Auman, *Makromol. Chem.* 185, 2319 (1984); "High Molecular Weight Polymers by Nickel Coupling of Aryl Polychlorides," I. Colon, G. T. Kwaiatkowski, *J. of Polymer Science, Part A, Polymer Chemistry*, 28, 367 (1990); M. Ueda and T. Ito, *Polymer J.*, 23 (4), 297 (1991); "Ethynyl-Terminated Polyarylates: Synthesis and Characterization," S. J. Havens and P. M. Hergenrother, *J. of Polymer Science: Polymer Chemistry Edition*, 2.2, 3011 (1984); "Ethynyl-Terminated Polysulfones: Synthesis and Characterization," P. M. Hergenrother, *J. of Polymer Science: Polymer Chemistry Edition*, 20, 31 31 (1982); K. E. Dukes, M. D. Forbes, A. S. Jeevarajan, A. M. Belu, J. M. DeDimone, R. W. Linton, and V. V. Sheares, *Macromolecules*, 29, 3081 (1996); G. Hougham, G. Tesoro, and J. Shaw, *Polym. Mater. Sci. Eng.*, 61, 369 (1989); V. Percec and B.C. Auman, *Makromol. Chem*, 185, 617 (1984); "Synthesis and characterization of New Fluorescent Poly(arylene ethers)," S. Matsuo, N. Yakoh, S. Chino, M. Mitani, and S. Tagami, *Journal of Polymer Science: Part A: Polymer Chemistry*, 32, 1071 (1994); "Synthesis of a Novel Naphthalene-Based Poly (arylene ether ketone) with High Solubility and Thermal Stability," Mami Ohno, Toshikazu Takata, and Takeshi Endo, *Macromolecules*, 27, 3447 (1994); "Synthesis and Characterization of New Aromatic Poly(ether ketones)," F. W. Mercer, M. T. Mckenzie, G. Merlino, and M. M. Fone, *J. of Applied Polymer Science*, 56, 1397 (1995); H. C. Zhang, T. L. Chen, Y. G. Yuan, Chinese Patent CN 85108751 (1991); "Static and laser light scattering study of novel thermoplastics. 1. Phenolphthalein poly(aryl ether ketone)," C. Wu, S. Bo, M. Siddiq, G. Yang and *T. Chen, Macromolecules*, 29, 2989 (1996); "Synthesis of t-Butyl-Substituted Poly(ether ketone) by Nickel-Catalyzed Coupling Polymerization of Aromatic Dichloride", M. Ueda, Y. Seino, Y. Haneda, M. Yoneda, and J.-I. Sugiyama, *Journal of Polymer Science: Part A: Polymer Chemistry*, 32, 675 (1994); "Reaction Mechanisms: Comb-Like Polymers and Graft Copolymers from Macromers 2. Synthesis, Characterzation and Homopolymerization of a Styrene Macromer of Poly(2,6-dimethyl-1,4-phenylene Oxide)," V. Percec, P. L. Rinaldi, and B.C. Auman, *Polymer Bulletin*, 10, 397 (1983); *Handbook of Polymer Synthesis Part A*, Hans R. Kricheldorf, ed., Marcel Dekker, Inc., New York-Basel-Hong Kong (1992); and "Introduction of Carboxyl Groups into Crosslinked Polystyrene," C. R. Harrison, P. Hodge, J. Kemp, and G. M. Perry, *Die Makromolekulare Chemie*, 176, 267 (1975), the disclosures of each of which are totally incorporated herein by reference.

While the invention has been described with reference to the structure disclosed, it is not confined to the details set forth, but is intended to cover such modifications or changes as may come within the scope of the following claims.

We claim:

1. A method of fabricating a micromechanical device defining a cavity therein, comprising the steps of:

providing a substrate defining a main surface;

depositing on the main surface a sacrificial layer of removable material, configured as a negative mold of the cavity;

depositing over the sacrificial layer a permanent layer of permanent material;

polishing the permanent layer to expose the sacrificial layer; and removing the sacrificial layer.

2. The method of claim 1, the substrate defining a heating surface in the main surface thereof, and wherein the step of depositing on the main surface a sacrificial layer of removable material comprises the step of depositing the sacrificial layer over the heating surface.

3. The method of claim 1, wherein the step of depositing on the main surface a sacrificial layer of removable material comprises the step of depositing the sacrificial layer whereby edges of the sacrificial layer form substantially right angles with the main surface of the substrate.

4. The method of claim 1, comprising the further steps of depositing on the permanent layer a second sacrificial layer of removable material; and depositing over the second sacrificial layer a second permanent layer of permanent material.

5. The method of claim 1, wherein a channel formed as a negative mold in the sacrificial layer has a dimension parallel to the main surface not less than about 3 micrometers and not more than about one centimeter.

6. The method of claim 1, wherein the sacrificial layer comprises polyimide.

7. The method of claim 6, wherein the permanent layer comprises probimer.

8. The method of claim 6, wherein the permanent layer comprises benzocyclobutenes.

9. The method of claim 6, wherein the permanent layer comprises silicon dioxide.

10. The method of claim 6, wherein the permanent layer comprises $Si_3N_4$.

11. The method of claim 6, wherein the permanent layer comprises polyimide, the polyimide of the permanent layer being more fully cured than the polyimide of the sacrificial layer.

12. The method of claim 6, wherein the permanent layer comprises polyimide, the polyimide of the permanent layer being more base-resistant than the polyimide of the sacrificial layer.

13. The method of claim 1, wherein the permanent layer comprises polyarylene ether.

14. The method of claim 13, wherein the sacrificial layer comprises a dry-film solder mask.

15. The method of claim 13, wherein the sacrificial layer comprises a plasma nitride.

16. The method of claim 13, wherein the sacrificial layer comprises a plasma oxide.

17. The method of claim 13, wherein the sacrificial layer comprises spin-on glass.

18. The method of claim 13, wherein the sacrificial layer comprises polyimide.

19. The method of claim 13, wherein the sacrificial layer comprises RISTON.

20. The method of claim 13, wherein the sacrificial layer comprises VACREL.

21. The method of claim 1, wherein the permanent layer comprises polyimide.

22. The method of claim 21, wherein the sacrificial layer comprises RISTON.

23. The method of claim 21, wherein the sacrificial layer comprises VACREL.

24. The method of claim 21, wherein the sacrificial layer comprises plasma nitride.

25. The method of claim 21, wherein the sacrificial layer comprises plasma oxide.

26. The method of claim 21, wherein the sacrificial layer comprises spin-on glass.

27. The method of claim 21, wherein the sacrificial layer comprises photoresist.

28. The method of claim 21, wherein the sacrificial layer comprises PSG.

29. The method of claim 1, wherein the permanent layer comprises polyphenylenes.

30. The method of claim 1, wherein the permanent layer comprises phenolphthalein-containing arylene ether.

31. The method of claim 1, wherein the permanent layer comprises probimer.

32. The method of claim 1, wherein the permanent layer comprises benzocyclobutene.

33. A method of fabricating an ink-jet printhead defining a plurality of channels therein, comprising the steps of:

providing a substrate defining a main surface;

depositing on the main surface a sacrificial layer of removable material, configured as a negative mold of the plurality of channels;

depositing over the sacrificial layer a permanent layer of permanent material; and removing the sacrificial layer.

34. The method of claim 33, the substrate defining a plurality of energizing surfaces in the main surface thereof, each energizing surface corresponding to one channel in the printhead, and wherein the step of depositing on the main surface a sacrificial layer of removable material comprises the step of depositing the sacrificial layer over the energizing surface.

35. The method of claim 34, wherein the step of depositing the sacrificial layer includes depositing the sacrificial layer within a perimeter of the energizing surface, thereby allowing the permanent layer to form a pit around the perimeter of the energizing surface.

36. The method of claim 33, wherein the step of depositing on the main surface a sacrificial layer of removable material comprises the step of depositing the sacrificial layer whereby edges of the sacrificial layer form substantially right angles with the main surface of the substrate.

37. The method of claim 33, comprising the further steps of depositing on the permanent layer a second sacrificial layer of removable material; and depositing over the second sacrificial layer a second permanent layer of permanent material.

38. The method of claim 33, wherein the sacrificial layer comprises polyimide.

39. The method of claim 38, wherein the permanent layer comprises probimer.

40. The method of claim 38, wherein the permanent layer comprises benzocyclobutenes.

41. The method of claim 38, wherein the permanent layer comprises silicon dioxide.

42. The method of claim 38, wherein the permanent layer comprises $Si_3N_4$.

43. The method of claim 38, wherein the permanent layer comprises polyimide, the polyimide of the permanent layer being more fully cured than the polyimide of the sacrificial layer.

44. The method of claim 38, wherein the permanent layer comprises polyimide, the polyimide of the permanent layer being more base-resistant than the polyimide of the sacrificial layer.

45. The method of claim 33, wherein the permanent layer comprises polyarylene ether.

46. The method of claim 45, wherein the sacrificial layer comprises a dry-film solder mask.

47. The method of claim 45, wherein the sacrificial layer comprises a plasma nitride.

48. The method of claim 45, wherein the sacrificial layer comprises a plasma oxide.

49. The method of claim 45, wherein the sacrificial layer comprises spin-on glass.

50. The method of claim 45, wherein the sacrificial layer comprises polyimide.

51. The method of claim 33, further comprising the step of polishing the permanent layer to expose the sacrificial layer.

* * * * *